US008028845B2

(12) United States Patent
Himes

(10) Patent No.: US 8,028,845 B2
(45) Date of Patent: Oct. 4, 2011

(54) TRUCK TRAILER REMOVEABLE RACK

(76) Inventor: Randy Himes, Granger, IN (US)

( * ) Notice: Subject to any disclaimer, the term of this patent is extended or adjusted under 35 U.S.C. 154(b) by 758 days.

(21) Appl. No.: 11/939,531

(22) Filed: Nov. 13, 2007

(65) Prior Publication Data

US 2009/0120888 A1 May 14, 2009

(51) Int. Cl.
*A47H 1/00* (2006.01)

(52) U.S. Cl. ..... 211/103

(58) Field of Classification Search ..... 211/90.02, 211/41.15, 103, 187, 190, 207, 105.5, 105.6, 211/4, 6, 7, 193, 150, 192; 16/422, 423; 312/245, 107.5; 108/47; 248/218.4, 242, 248/245, 246, 300, 220.41, 221.41, 70, 68.1, 248/73, 74.1

See application file for complete search history.

(56) References Cited

U.S. PATENT DOCUMENTS

| | | | | | |
|---|---|---|---|---|---|
| 2,453,254 | A | * | 11/1948 | Odin | 248/242 |
| 3,043,438 | A | * | 7/1962 | Chmielewski | 211/105.6 |
| 3,151,576 | A | * | 10/1964 | Patterson | 108/2 |
| 3,463,433 | A | * | 8/1969 | Coe et al. | 248/242 |
| 3,795,379 | A | * | 3/1974 | Gray | 248/242 |
| 4,037,896 | A | * | 7/1977 | Kennedy et al. | 312/281 |
| 4,135,655 | A | * | 1/1979 | Brown | 294/166 |
| 4,350,098 | A | * | 9/1982 | Shirono et al. | 108/6 |
| 4,455,007 | A | * | 6/1984 | Varon et al. | 248/251 |
| D294,221 | S | * | 2/1988 | Sheftel | D8/381 |
| 4,753,355 | A | * | 6/1988 | Hall et al. | 211/105.1 |
| 4,789,071 | A | * | 12/1988 | Larsson | 211/208 |
| 4,938,442 | A | * | 7/1990 | Mastrodicasa | 248/250 |
| 4,971,281 | A | * | 11/1990 | Steinbeck | 248/222.13 |
| 5,063,715 | A | * | 11/1991 | Goodman | 52/36.6 |
| 5,104,269 | A | * | 4/1992 | Hardison | 410/149 |
| 5,308,031 | A | * | 5/1994 | Evenson | 248/222.13 |
| 5,378,093 | A | * | 1/1995 | Schroeder | 410/32 |
| 5,460,345 | A | * | 10/1995 | Trevaskis | 248/225.21 |
| 5,526,944 | A | * | 6/1996 | Merl | 211/87.01 |
| 5,816,419 | A | * | 10/1998 | Lamson | 211/150 |
| 6,554,142 | B2 | * | 4/2003 | Gray | 211/26 |
| 6,935,523 | B2 | * | 8/2005 | Ahn | 211/195 |
| 6,948,691 | B2 | * | 9/2005 | Brock et al. | 248/222.13 |
| 7,150,361 | B2 | * | 12/2006 | Calleja | 211/49.1 |
| 7,357,362 | B2 | * | 4/2008 | Yang et al. | 248/221.11 |
| 7,438,268 | B2 | * | 10/2008 | Kologe | 248/220.22 |
| 7,497,344 | B2 | * | 3/2009 | Chen | 211/187 |
| 7,540,244 | B2 | * | 6/2009 | Gregory | 108/108 |
| 7,699,279 | B2 | * | 4/2010 | Chen et al. | 248/220.41 |
| 2001/0040203 | A1 | * | 11/2001 | Brock et al. | 248/222.11 |
| 2002/0027115 | A1 | * | 3/2002 | Gay et al. | 211/187 |
| 2002/0030027 | A1 | * | 3/2002 | Welsch | 211/90.02 |
| 2006/0054577 | A1 | * | 3/2006 | Strating et al. | 211/87.01 |
| 2008/0203040 | A1 | * | 8/2008 | Kologe | 211/103 |
| 2009/0120888 | A1 | * | 5/2009 | Himes | 211/103 |
| 2009/0266778 | A1 | * | 10/2009 | Garcia et al. | 211/89.01 |

* cited by examiner

*Primary Examiner* — Jennifer E. Novosad
(74) *Attorney, Agent, or Firm* — Robert J. Sayfie

(57) ABSTRACT

A rack having a member; the member having a clip portion; the clip portion having a wall, the wall having a bottom indent and a top indent; whereby the top indent and the bottom indent are capable of being removably secured to an E-track.

3 Claims, 6 Drawing Sheets

TRUCK TRAILER REMOVEABLE RACK

BACKGROUND OF THE INVENTION

This invention relates to a rack that may be attached to an E-track, particularly vertically oriented E-tracks.

Enclosed trailers use E-tracks with E-track straps to secure items therebetween, and adjacent to the sidewalls of the trailer. Before the present invention, E-track straps were used. These are straps made of fabric or cloth that can be secured or tied to the E-tracks. They are often not adjusted to the correct length, thus this looseness does not properly secure beams or cargo. Also, it may be difficult to tighten a strap that is above ones shoulders.

As can be seen, there is a need for a rigid rack that attaches to E-tracks to hold items in trailers.

SUMMARY OF THE INVENTION

An aspect of the present invention is a rack (10), comprising: a member (20); said member (20) having a clip portion (70); said clip portion (70) having a wall (74), said wall (74) having a bottom indent (80) and a top indent (90); whereby said top indent (90) and said bottom indent (80) are capable of being removably secured to an E-track.

Another aspect is a rack (10) for an E-track, comprising: a member (20);

said member (20) having a clip portion (70); said clip portion (70) having a wall (74), said wall (74) having a bottom indent (80) and a top indent (90); whereby said top indent (90) and said bottom indent (80) are capable of being removably secured to an E-track.

Yet another aspect is a method of using a rack (10) with and E-track, comprising the steps of: installing of upper rack (200), positioning cargo (300), installing a lower rack (400).

These and other features, aspects and advantages of the present invention will become better understood with reference to the following drawings, description and claims.

REFERENCE NUMERALS

Figure 1:
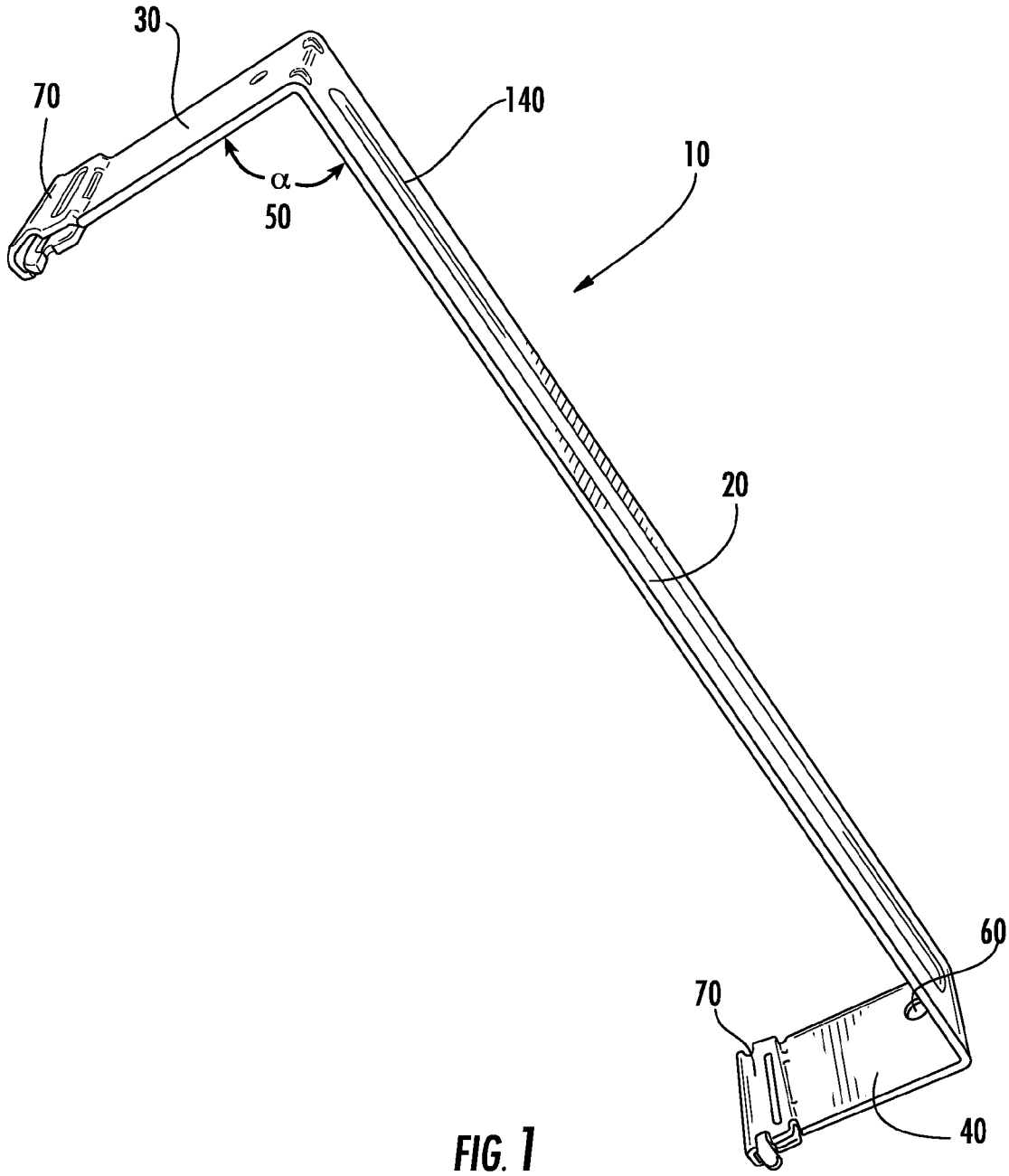
FIG. 1 is a pictorial view of an exemplary embodiment of the present invention.

10 rack
20 member
30 first side
40 second side
50 angle between the first side and the member
60 aperture
70 clip portion
71 clip portion proximal side
72 clip portion distal side

74 wall
76 wall spring receiving member
80 bottom indent
90 top indent
99 E-track
100 clip
102 clip spring receiving member
104 shoulder
106 neck
110 slot
120 pivot
130 spring
140 reinforced portion
150 distance between top indent 90 and bottom indent 80
160 height of member 20
170 depth of top indent 90
180 recess of bottom indent 80
190 width of top indent 90
195 width of bottom indent 80
200 installing of upper rack
300 positioning cargo
400 installing of lower rack
500 removing of lower rack

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

FIG. 1 illustrates an exemplary embodiment of the present invention, referred to as a rack 10. The rack 10 is comprised of a member 20 that may have two opposed clip portions 70. The member 20 may have a first side 30 and a second side 40. In one exemplary embodiment, the first side 30 and second side 40 may be substantially parallel with respect to the other. In one exemplary embodiment, the member 20 may be substantially perpendicular with at least one of the first side 30 or the second side 40, in which case the angle between the member 20 and at least one of either the first side 30 or second side 40 may be 90°. This angle is represented in FIG. 1 as $\alpha$. In other embodiments this angle may be something other than 90°. An aperture 60 may be disposed in the member 20, or the aperture 60 may be disposed in at least one of the first side 30 or second side 40. This aperture 60 may be used to hang things from.

Figure 2:
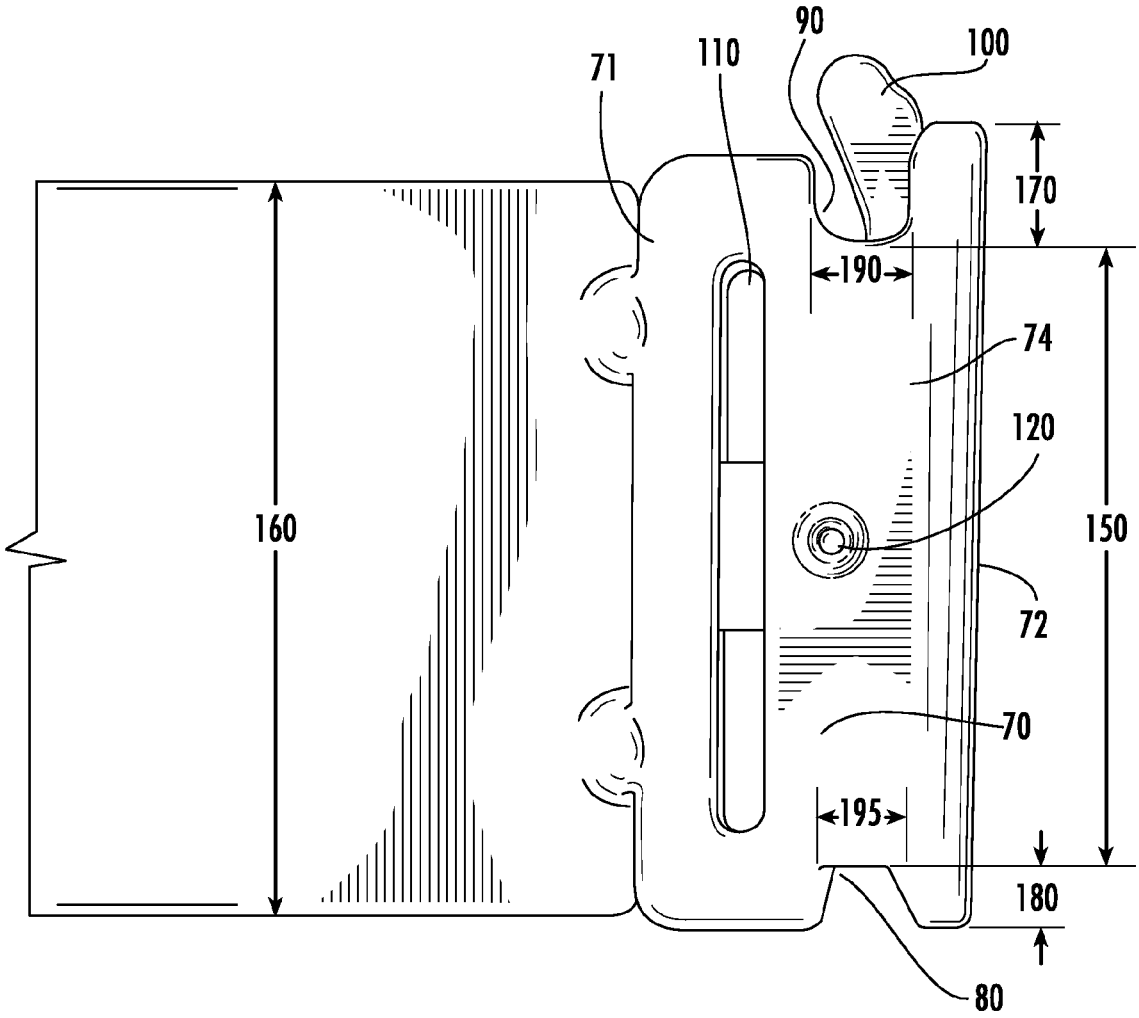
FIG. 2 is a pictorial view of an exemplary embodiment of a clip portion of the present invention.

FIG. 2 illustrates an exemplary embodiment of a clip portion 70. The clip portion 70 may have a bottom indent 80, a top indent 90, and a clip 100. The clip 100 may pivot about a pivot 120. The clip portion 70 may have a slot 110. The clip portion 70 may have a clip portion proximal side 71, and a clip portion distal side 72, which may be further from the member 20 than the clip portion proximal side 71. The clip portion 70 may have a wall 74 that extends from clip portion proximal side 71 to the clip portion distal side 72.

Figure 3:
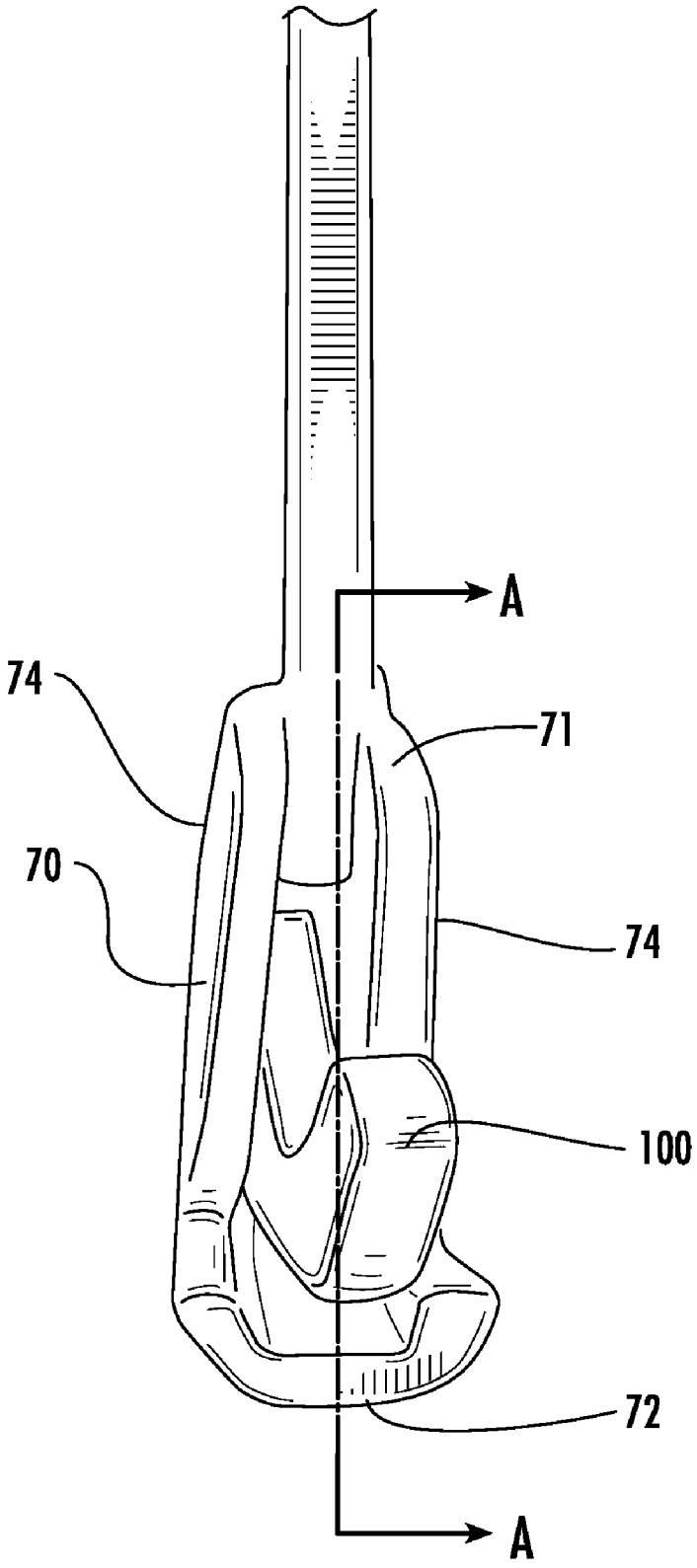
FIG. 3 is a pictorial view of an exemplary embodiment of a top view of the clip portion.

As best seen in FIG. 3, the distance between opposed sides of the wall 74 may be greater near the clip portion distal side 72 than the clip portion proximal side 71. FIG. 3 illustrates an exemplary embodiment of a clip portion 70 of the present invention. The clip portion 70 may contain a clip 100 therein.

Figure 4:
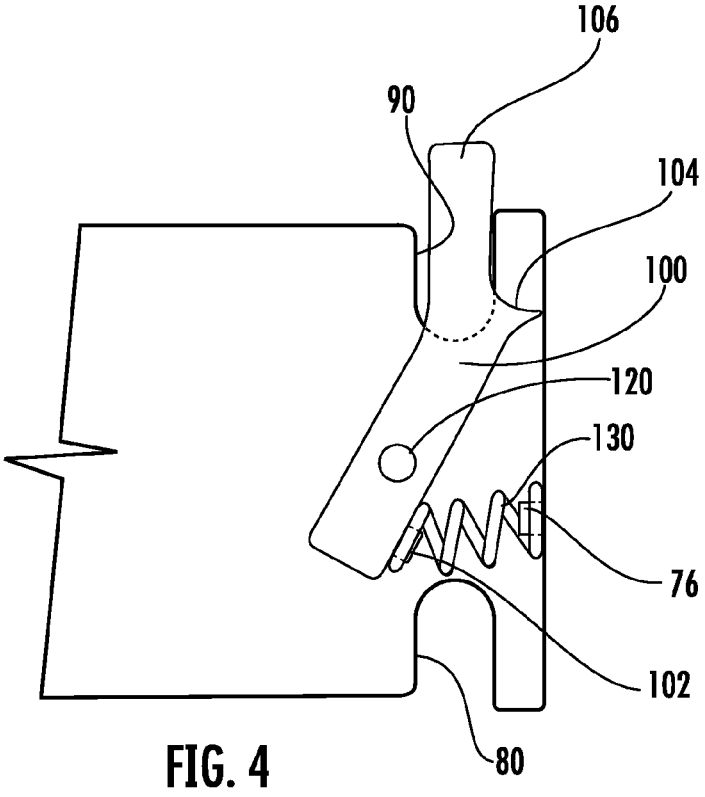
FIG. 4 is a cross sectional view of an exemplary embodiment of the present invention of the clip in a closed position along the line A-A of FIG. 3.
Figure 5:
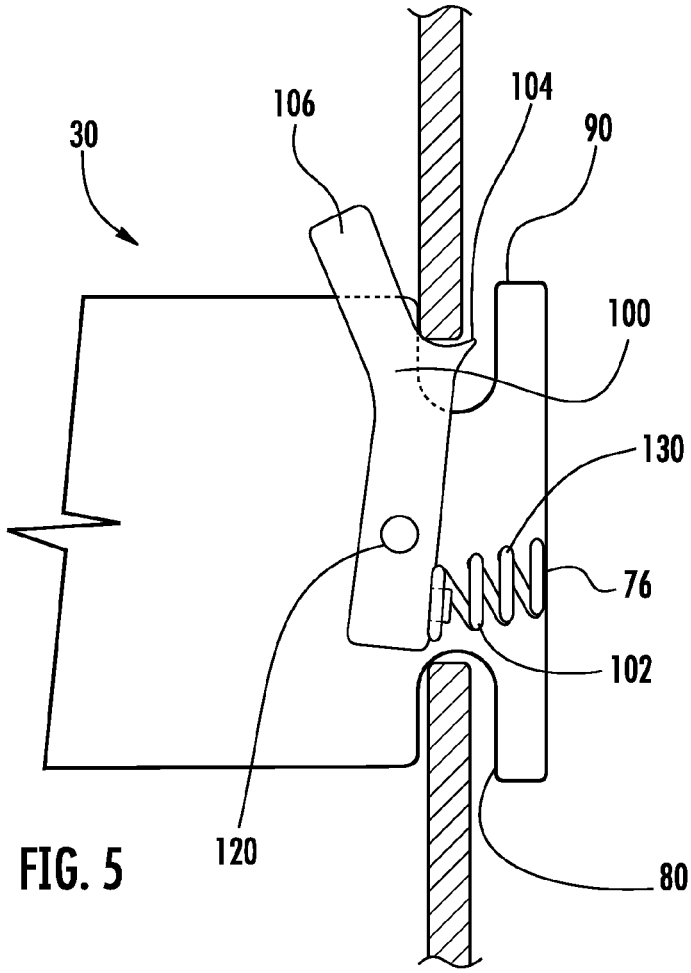
FIG. 5 is a second cross sectional view of an exemplary embodiment of the present invention of the clip in an open position along the line A-A of FIG. 3.
Figure 6A:
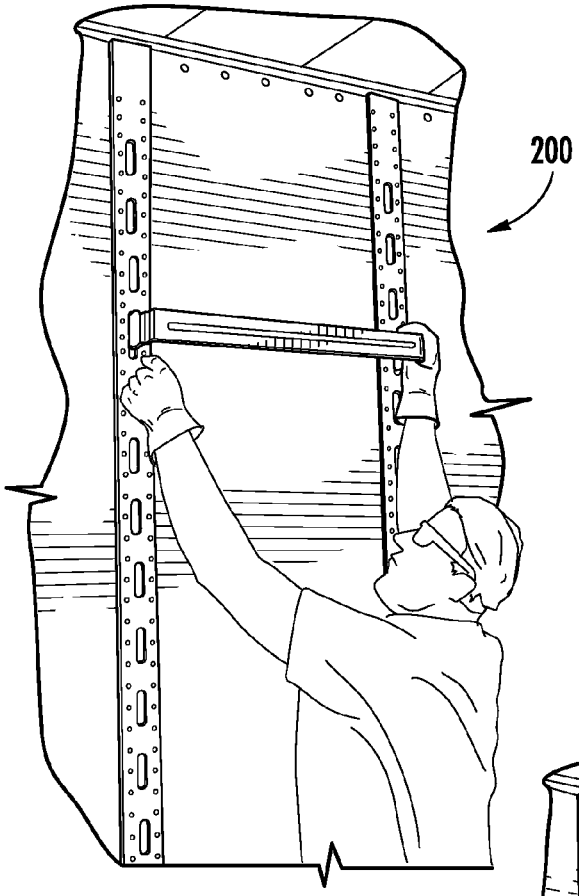
FIG. 6 is an exemplary embodiment of a method of using the present invention.
Figure 6B:
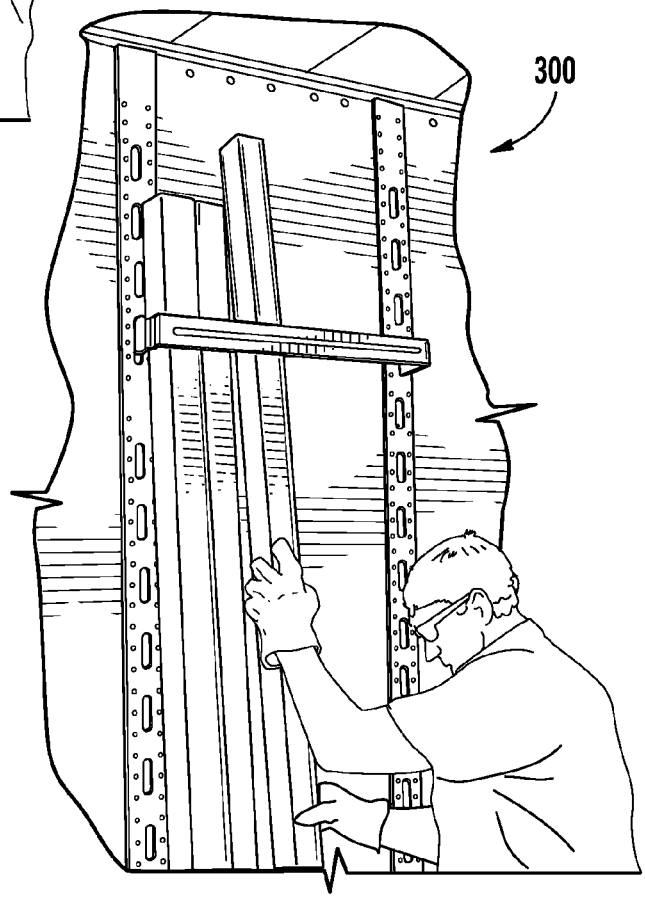
Figure 6C:
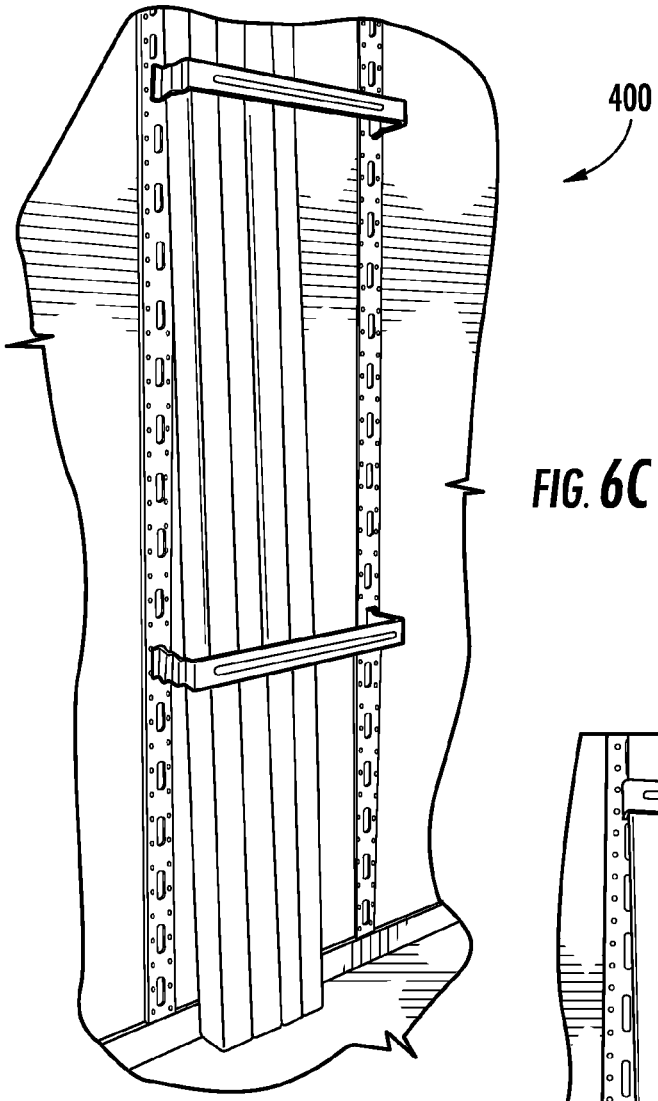
Figure 6D:
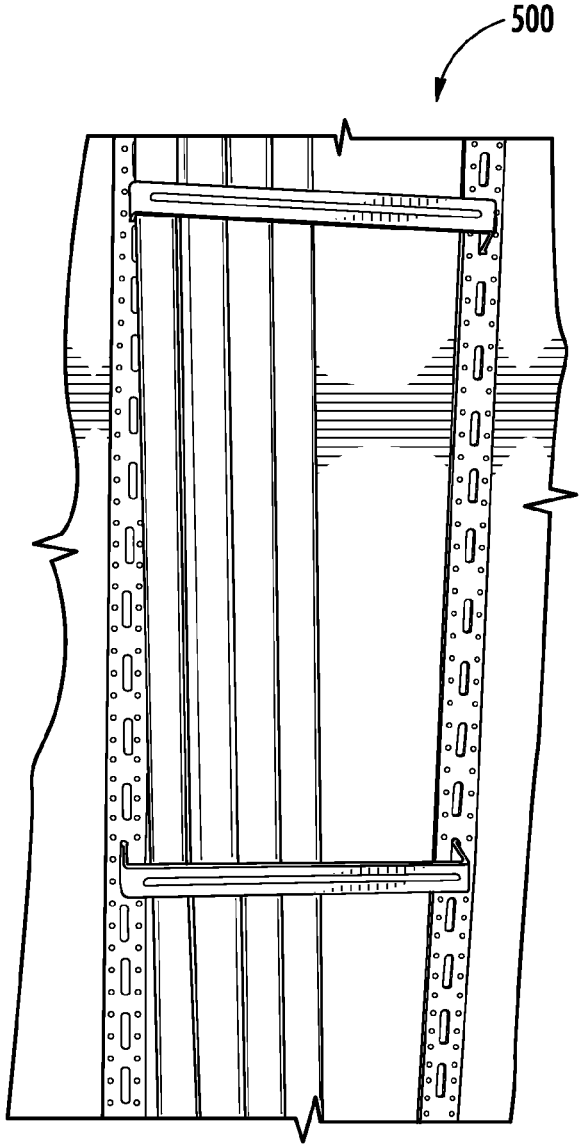

FIGS. 4 and 5 illustrate one exemplary embodiment of how the clip 100 may be pivotally secured to the clip portion 70 by a pivot 120. This pivot 120 may be a rivet, or other member. A spring 130 may be secured at one end to a wall spring receiving member 76. The wall spring receiving member 76 may be a cylindrical shaped extension. The spring 130 may be able to fit over the wall spring receiving member 76 at one end; and at an opposed end the spring 130 may be received by a clip spring receiving member 102. The clip spring receiving member 102 may be an extension extending from the clip 100 to the direction of the wall spring receiving member 76, so that the spring 130 may be biasly disposed on both the wall spring receiving member 76 and the clip spring receiving member 102 to bias the clip 100 towards the clip portion distal side 72.

As illustrated in FIG. 4, the clip 100 may have a shoulder 104 that may contact the clip portion distal side 72 when the clip 100 is positioned in what is referred to herein as a "closed" position. As illustrated in FIG. 5, a neck 106 may extend upwardly from the shoulder 104. The neck 106 may be positioned or pulled back to place the clip 100 or shoulder 104 in an "open" position. This way the neck 106 and shoulder 104 may aid in keeping the rack 10 in a removably secured position with an E-track 99 (shown in section in FIG. 5). The neck 106 or shoulder 104 may contact the E-track to secure the rack 10 with respect to the E-track.

A slot 110 may be disposed near the clip portion 70 or in the clip portion 70.

In one exemplary embodiment, the member may have a reinforced portion 140 to increase the strength of the member 20. The reinforced portion 140 may be a curved radii that expands the length of the present invention rack 10.

In one exemplary embodiment, the first side 30 or second side 40 may have an aperture 60. The aperture may be used to hang things from.

FIGS. 6A-6D may illustrate one method of use of the present invention 10. The clip 100 can be "opened" by pulling the neck 106 toward the clip portion proximal side 71, then the rack 10 may be installed on a slot of an E-track by positioning the top indent portion 90 around the respective portion, or top of the slot, of the E-track, then the bottom indent 80 may rest on the bottom of the E-track slot. This step may be called the installing of upper rack 200. The next step may be positioning cargo 300. FIG. 6 illustrates the use of two racks 10 to secure bars, such as deck bars. Then deck bars or cargo may be positioned 300 between the rack 10 and the trailer wall. The third step may be installing a lower rack 400. Then, to access cargo, one can execute the step of removing the lower rack 500.

The dimensions of the rack 10 may vary. For example the beam 10 may be a variety of lengths to accommodate for different positions of E-track placement. In one embodiment, the clip portions 70 are disposed at a distance of 24 inches. This embodiment may be used with vertically oriented E-tracks being disposed about 24 inches apart. In another embodiment, the clip portions 70 are disposed at a distance of 32 inches. This embodiment may be used with vertically oriented E-tracks being disposed about 32 inches apart.

In one exemplary embodiment, the first side 30, and the second side 40 are about 5 5/16 inches in length. In another embodiment, hinges could be positioned between the member 20 and at least one of either the first side 30 and the second side 40, so that it would be easier to place the clips in the E-tracks. Alternatively, a hinge or pivot mechanism may be disposed between the clip portion 70 and at least one of the first side 30 and/or second side 40, which would allow the clip portion 70 to hinge or pivot with respect to the first side 30 or second side 40.

The rack 10 can be comprised of a variety of cross sectional shapes and configurations.

In one exemplary embodiment, the shortest distance 150 between the top indent 90 and the bottom indent 80 is about 2 1/8 inches. In one exemplary embodiment, the height 160 of the member is about 2 9/16 inches. In one exemplary embodiment the depth 170 of the top indent 90 is about 3/8 of an inch. In one exemplary embodiment, the bottom indent 80 is recessed 180 about 3/16 of an inch. In one exemplary embodiment the distance across 190 the top indent 90 is about 3/8 of an inch. In one embodiment the distance across 195 the bottom indent 80 is about 1/4 of an inch.

This rack 10 may have additional applications beyond use in trailer E-tracks.

Further, although the present invention may use a clip 100 to secure the rack 10 to the E-track, the clip 100 may not be necessary. For example, the top indent 90 and bottom indent 80 may be all that is needed to position the rack 10 to the E-track 99.

In one exemplary embodiment the rack 10 may be comprised of metal or a metal allow. However other materials that can form a rigid structure can also be used, such as steel, composites, plastics, aluminum, or wood.

A rack 10 of the present invention may be formed with a variety of processes, such as the extrusion process. further, the rack 10 may be formed by a press bending process or a stretch forming process. Other methods may also be used to make the present inventions rack 10.

It should be understood, of course, that the foregoing relates to exemplary embodiments of the invention and that modifications may be made without departing from the spirit and scope of the invention as set forth in the following claims.

I claim:

1. A rack (10), comprising:

a member (20);

said member (20) having a clip portion (70); said clip portion (70) having a wall (74), said wall (74) having a bottom indent (80) and a top indent (90);

whereby said top indent (90) and said bottom indent (80) are capable of being removably secured to an E-track, a clip (100) pivotally secured to the wall (74) by a pivot (120) wherein said clip (100) has a shoulder 104 that is capable of contacting said wall (74); said clip (100) having a clip spring receiving member (102) that extends from said clip (100) towards said wall (74); said clip (100) having a neck (106) that extends upwardly from said shoulder (104); said wall having a wall spring receiving member 76;

whereby a spring (130) may be disposed on said clip spring receiving member (102) and said wall spring receiving member (76), and said spring (130) capable of biasing said shoulder (104) against said wall (74); and said clip portion (70) having a clip portion distal side (72) and a clip portion proximal side (71); said clip portion proximal side (71) being disposed between said clip portion distal side (72) and said member (20);

and said neck (106) may be capable of being pulled away from said clip portion distal side (72).

2. The rack of claim 1, further comprising a slot (110) disposed in the clip portion (70), said slot (110) running in a substantially vertical direction when the rack (10) is positioned on vertical E-racks.

3. A rack (10) for an E-track, comprising:

a member (20);

said member (20) having a clip portion (70); said clip portion (70) having a wall (74), said wall (74) having a bottom indent (80) and a top indent (90);

whereby said top indent (90) and said bottom indent (80) are capable of being removably secured to an E-track.

wherein said clip (100) has a shoulder (104) that is capable of contacting said wall (74); said shoulder (104) is capable of biasing toward a clip portion distal side (72)

further comprising said clip (100) having a clip spring receiving member (102) that extends from said clip (100) towards said wall (74); said clip (100) having a neck (106) that extends upwardly from said shoulder (104); said wall having a wall spring receiving member 76; whereby a spring (130) may be disposed on said clip spring receiving member (102) and said wall spring receiving member (76), and said spring (130) capable of biasing said shoulder (104) against said wall (74); and said clip portion (70) having a clip portion distal side (72) and a clip portion proximal side (71); said clip portion proximal side (71) being disposed between said clip portion distal side (72) and said member (20); and said neck (106) may be capable of being pulled away from said clip portion distal side (72).

* * * * *